US006854162B2

(12) United States Patent
Emerson et al.

(10) Patent No.: US 6,854,162 B2
(45) Date of Patent: Feb. 15, 2005

(54) DOOR HINGE COVER

(76) Inventors: Laura E. Emerson, 7552 Vincent Dr., Toano, VA (US) 23168; Christopher S. Emerson, 7552 Vincent Dr., Toano, VA (US) 23168

( * ) Notice: Subject to any disclaimer, the term of this patent is extended or adjusted under 35 U.S.C. 154(b) by 33 days.

(21) Appl. No.: 10/139,465

(22) Filed: May 6, 2002

(65) Prior Publication Data

US 2002/0178543 A1 Dec. 5, 2002

Related U.S. Application Data

(60) Provisional application No. 60/288,781, filed on May 5, 2001.

(51) Int. Cl.[7] ..... B05C 21/00

(52) U.S. Cl. ..... 16/250; 16/251; 16/DIG. 40

(58) Field of Search ..... 16/256, 251, DIG. 40

(56) References Cited

U.S. PATENT DOCUMENTS

| | | | | | |
|---|---|---|---|---|---|
| 2,342,453 | A | * | 2/1944 | Colucci | 16/250 |
| 2,925,064 | A | | 2/1960 | Kahn | |
| 3,961,602 | A | * | 6/1976 | Dresser | 118/505 |
| 4,691,409 | A | * | 9/1987 | Torgerson et al. | 16/250 |
| 4,796,330 | A | * | 1/1989 | Ziegler | 16/251 |
| 4,802,259 | A | * | 2/1989 | Geslewitz | 16/251 |
| 5,056,191 | A | | 10/1991 | Love | |
| 5,198,031 | A | * | 3/1993 | Derstine | 118/505 |
| 5,224,240 | A | | 7/1993 | Smith et al. | |
| 5,432,979 | A | | 7/1995 | Harper | |
| 5,722,120 | A | * | 3/1998 | Bindschatel et al. | 16/250 |
| 6,165,269 | A | | 12/2000 | Kathe | |
| 6,572,949 | B1 | * | 6/2003 | Lewis et al. | 428/99 |

FOREIGN PATENT DOCUMENTS

| | | |
|---|---|---|
| DE | 953576 | 3/1964 |
| JP | 60051568 | 3/1985 |

* cited by examiner

*Primary Examiner*—Suzanne Dino Barrett
*Assistant Examiner*—Mark Williams
(74) *Attorney, Agent, or Firm*—Kimberly A. Chasteen

(57) ABSTRACT

A door hinge mask completely protects a door hinge during painting, is reusable, can be used on a hanging door easily and allows movement of the door during the painting process. The device includes two portions used in combination; one portion for protecting the hinge plates and a portion for protecting the hinge cylinder. The hinge plate protector is made from a flexible material and removably attaches to the hinge plates using a magnetic material. The hinge cylinder protector is also made from a flexible material and removably attaches to the hinge cylinder using a magnetic material. The two portions used in combination completely protect the door hinge during painting.

9 Claims, 6 Drawing Sheets

DOOR HINGE COVER

CROSS REFERENCE TO RELATED APPLICATION

The present application claims priority from U.S. Provisional Application Ser. No. 60/288,781, filed May 5, 2001.

BACKGROUND OF THE INVENTION

1. Field of the Invention

The present invention relates to door hinge covers. In particular, the present invention relates to door hinge covers which protect door hinges during painting.

2. Description of the Related Art

When painters paint a door and the surrounding doorframe, several methods exist for preventing the door hinges from being accidentally painted. Protecting the hinge plates and hinge cylinder from paint is difficult due to the position of the hinges and their method of attachment to the door and doorframe. The painter can paint the door before it is hung or remove the door from the door hinges. As it is not commonly possible to paint the door before it is hung and very time consuming to remove the door, paint it, wait for it to dry and then rehang the door, these are not desirable solutions. Another option is to use masking tape to cover the door hinges. Again, this is very time consuming, as masking tape does not properly fit. Additionally, the adhesive backing can damage or dirty the door hinge. Further, masking tape is not reusable. As described below, several other methods exist for protecting door hinges during the painting process.

U.S. Pat. No. 6,165,269 shows a set of protective masks for protecting room and door hardware during the painting process. The set includes masks for door hinges, doorknobs, deadbolts, outlets and switches. The masks are plastic and attach using a pressure fit rather than by means of magnets.

U.S. Pat. No. 5,224,240 shows a hinge mask for protecting half of a hinge on an unhung door from paint damage. The device cannot be used on a hanging door.

U.S. Pat. No. 5,198,031 shows a mask for a door hinge. This device includes an inflexible hinge cylinder cover which protects the top and sides of the hinge cylinder but does not protect the bottom surface. Furthermore, the design of this device does not allow the door to be opened during the painting process.

U.S. Pat. No. 5,056,191 shows a hinge cover for protecting the hinge plates during painting. This device uses adhesive to attach to the hinge plates and, thus is not reusable. Furthermore, no protection for the hinge cylinder is provided.

U.S. Pat. No. 4,691,409 shows a general mask for painting. It consists of an elastic sheet which is connected to the item to be masked. While it can be used to protect the hinge cylinder, it cannot be used to protect the hinge plates.

Therefore, there has been and continues to be a need for a reusable, easy-to-use, and practical door hinge mask for use during painting.

SUMMARY OF THE DISCLOSURE

A reusable door hinge mask is described which includes a hinge plate protector and a hinge cylinder protector. The door hinge cover protects door hinge plates and hinge cylinders during the painting process. The hinge plate protector is made from a flexible material, preferably nonporous such as vinyl or plastic, and has two outer external portions which include a magnetic element such as flexible magnetic sheeting, preferable with an adhesive backing for ease of use. These magnetic elements attach the hinge plate protector to the hinge plates. The central portion of the hinge plate protector does not include a magnetic means. Because most door hinge plates are generally rectangular, the hinge plate protector is preferable of a rectangular shape. It is clearly preferred that the hinge plate protector be of a shape and size to completely cover the door hinge plates but not extend beyond them.

The hinge cylinder protector is also made of a flexible material; again, preferably nonporous such as vinyl or plastic. The hinge cylinder includes a central, open box-shaped portion having upper and lower surfaces, two side surfaces and a rear surface so that it may cover one side of the hinge cylinder. The two side surfaces of the central portion include a magnetic element for attaching to the hinge cylinder. Extending from the upper and lower surfaces of the hinge cylinder protector are two elongate straps which connect the hinge cylinder protector to the hinge cylinder. These two straps may connect to each other or to the hinge plate protector in order to retain the hinge cylinder protector in its proper location. This connection may be accomplished by hook and loop fastener, snaps, buttons, hooks or other similar attachment means.

It is therefore an object of the present invention to provide a door hinge mask for use during painting.

It is another object of the present invention to provide a door hinge mask which protects the hinge cylinder and hinge plates.

It is another object of the present invention to provide a door hinge mask which can be used on a hanging door.

It is another object of the present invention to provide a door hinge mask which allows movement of the door during the painting process.

It is yet another object of the present invention to provide a door hinge mask which is convenient and easy to use.

It is yet a further object of the present invention to provide a door hinge mask which has a simple design which is reusable.

Finally, it is an object of the present invention to accomplish the foregoing objectives in a simple and cost effective manner.

Figure 1:
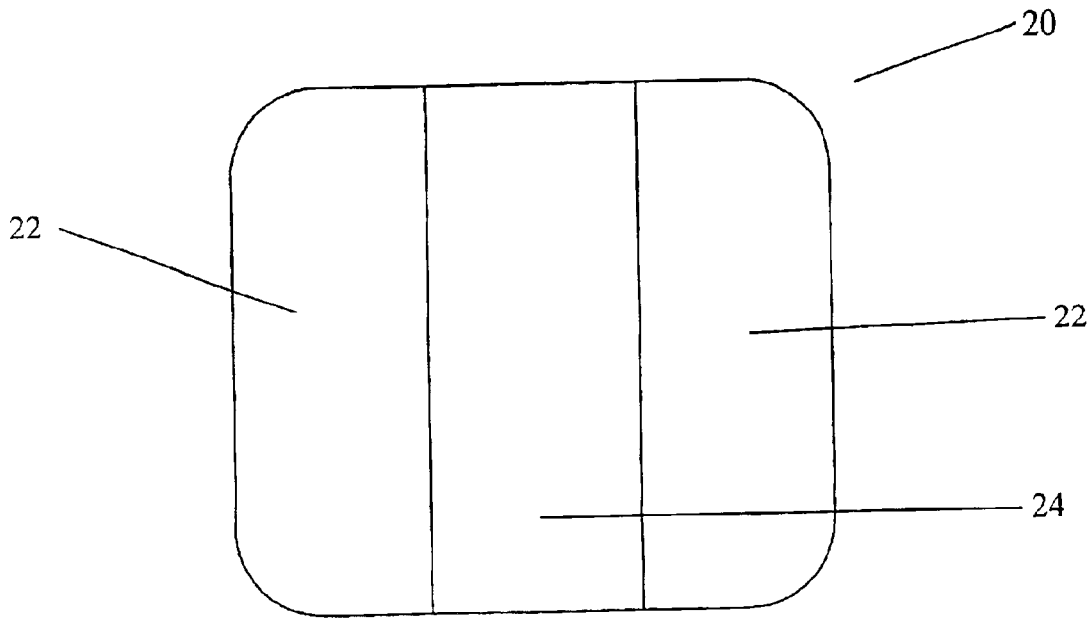
FIG. 1 is a bottom view of the hinge plate protector portion of the present invention.
Figure 2:
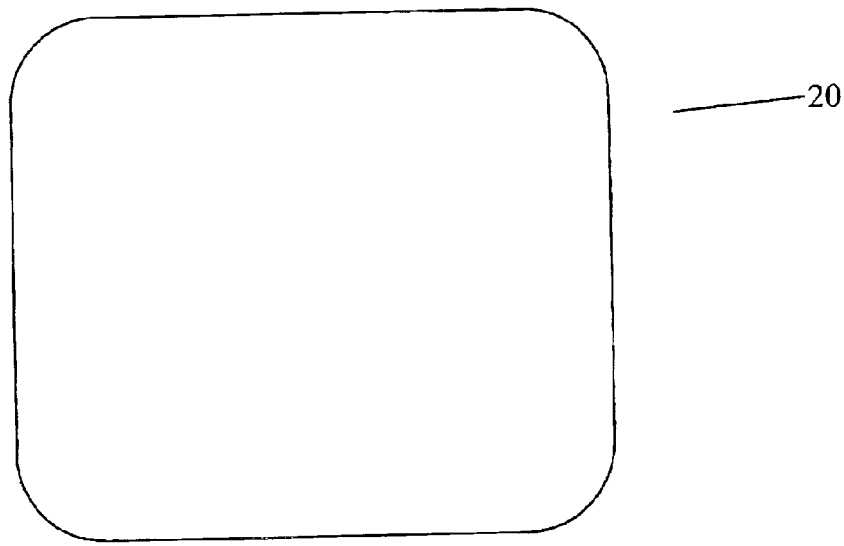
FIG. 2 is a top view of the hinge plate protector portion of the present invention.
Figure 3:
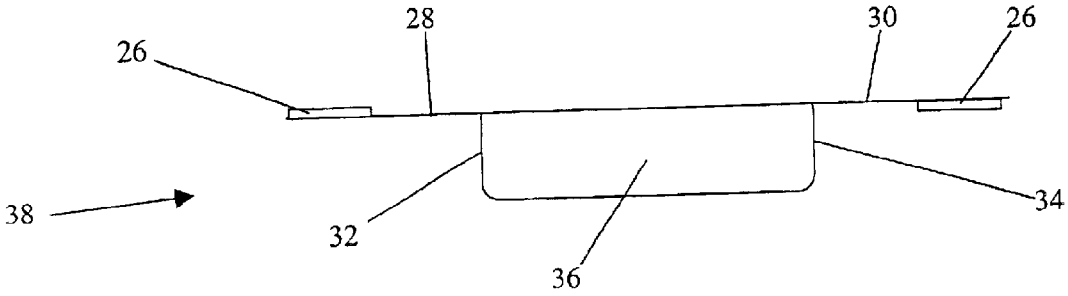
FIG. 3 is a side view of the hinge cylinder protector portion of the present invention.
Figure 4:
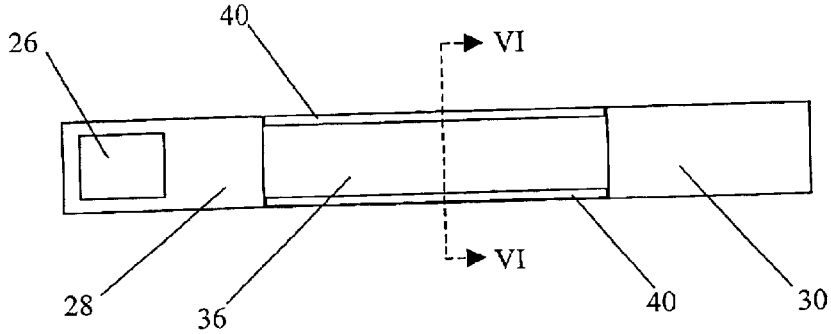
FIG. 4 is a top view of the hinge cylinder protector portion of the present invention.
Figure 5:
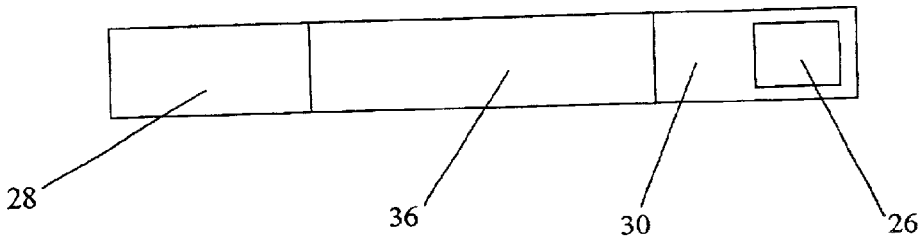
FIG. 5 is a bottom view of the hinge cylinder protector portion of the present invention.
Figure 6:
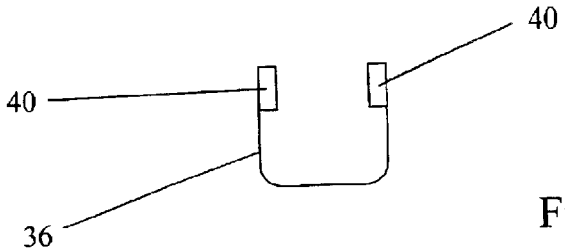
FIG. 6 is a cross-sectional view taken along line VI—VI in FIG. 4.

| Element List | |
|---|---|
| 20 | hinge plate protector |
| 22 | magnet |
| 24 | central portion of hinge plate protector |
| 26 | hook and loop fastener |
| 28 | strap |
| 30 | strap |
| 32 | top surface of central portion of hinge cylinder protector |
| 34 | bottom surface of central portion of hinge cylinder protector |
| 36 | central portion of hinge cylinder protector |
| 38 | hinge cylinder protector |
| 40 | magnet |
| 42 | hook and loop fastener |
| 44 | hinge cylinder |
| 46 | hinge plate |

DETAILED DESCRIPTION OF THE PREFERRED EMBODIMENT

The following detailed description is of the best presently contemplated modes of carrying out the invention. This description is not to be taken in a limiting sense, but is made merely for the purpose of illustrating general principles of embodiments of the invention.

The present invention provides a door hinge mask which completely protects the door hinge, is reusable, can be used on a hanging door easily and allows movement of the door during the painting process. The device includes two portions used in combination; one portion for protecting the hinge plates and a second portion for protecting the hinge cylinder. The hinge plate protector is made from a flexible material and removably attaches to the hinge plates using a magnetic material. The hinge cylinder protector is also made from a flexible material and removably attaches to the hinge cylinder using a magnetic material. The two portions used in combination completely protect the door hinge during painting.

A preferred embodiment of the door hinge mask is shown in FIGS. 1–6. The first portion of the present invention is the hinge plate protector 20 which consists of a section of flexible material shaped to approximately cover the surface of the door hinge plates 46 (shown in FIG. 9). This material is nonporous and preferably durable to allow for repeated use and such that it can withstand repeated contact with paint. Materials such as vinyl or plastic are preferred; however other nonporous, flexible materials will also work. Magnetic material 22 is adhered to the outer edges of the hinge plate protector 20. Preferably, this material is thin, flexible and shaped such that it extends to the edges of the hinge plate protector 20 as shown. Flexible magnetic sheets having an adhesive backing are particularly preferable. Also, as is shown, the central portion 24 of the hinge plate protector 20 is not covered by the magnetic material in the preferred embodiment. This central portion 24 protects the hinge cylinder 44 surface located adjacent to the hinge plates 46.

The second portion of the preferred embodiment of the present invention is the hinge cylinder protector 38. The hinge cylinder protector 38 is also preferably made from a nonporous, flexible, durable material such as vinyl or plastic.

The hinge cylinder protector generally includes a central portion 36 and two straps 28, 30 extending from the central portion 36. The central portion 36 is shaped such that it will cover the hinge cylinder 44 to protect it during painting. The central portion 36 is preferably generally open box-shaped having two side surfaces, upper 32 and lower 34 surfaces and a rear surface. The two side surfaces and the rear surface are at least as long as and at least as wide as the hinge cylinder 44. The outer edges of the two side surfaces include a magnetic material 40. This magnetic material is again preferably thin and flexible.

The two straps 28,30 extend from the upper 32 and lower 34 surfaces of the central portion 36. The strap portions are designed to connect to each other by, for example, hook and loop fastener 26. Thus, the first strap portion 28 includes hook and loop fastener 26 on its upper surface while the second strap portion 30 includes hook and loop fastener 26 on its lower surface. Clearly, other fasteners are contemplated such as snaps, hooks and buttons. So long as the connection is reusable and durable, it will function with the present invention.

Figure 7:
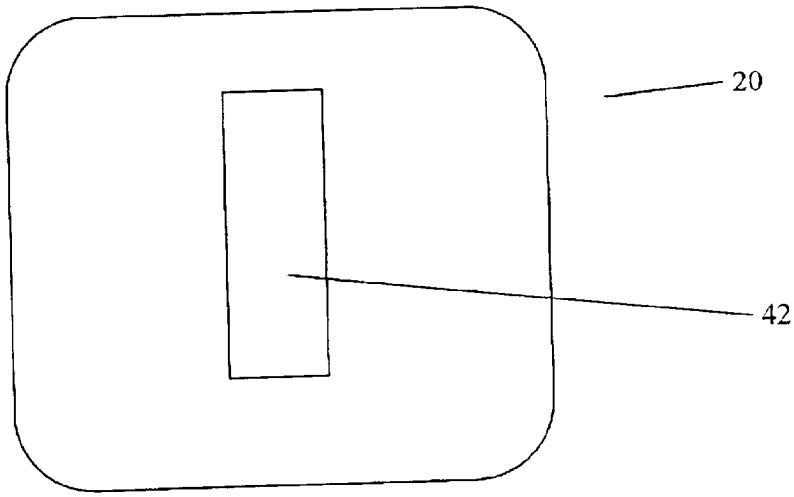
FIG. 7 is a top view of the hinge plate protector portion of an alternate embodiment of the present invention.
Figure 8:
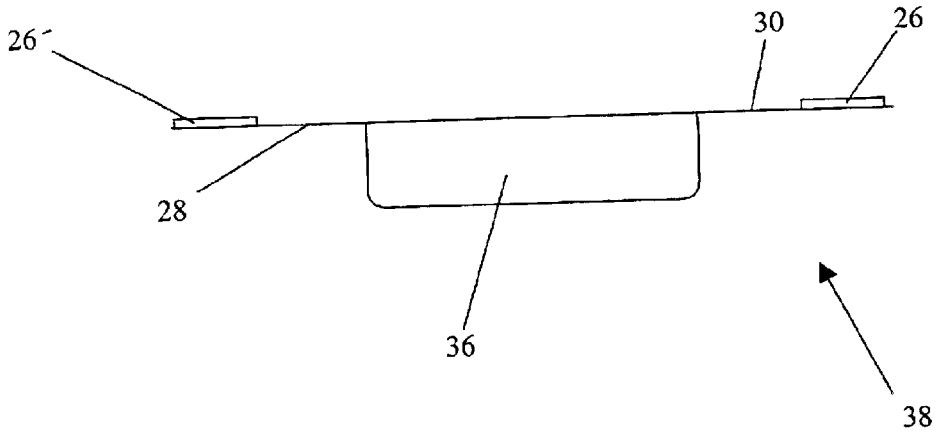
FIG. 8 is a side view of the hinge cylinder protector portion of an alternate embodiment of the present invention.

Alternatively, as shown in FIGS. 7 and 8, the hinge plate protector 20' may include hook and loop fastener 42 on the nonmagnetic surface. In this embodiment, the straps 28', 30' include hook and loop fastener 26' on the upper surface of each strap 28', 30'.

Figure 9:
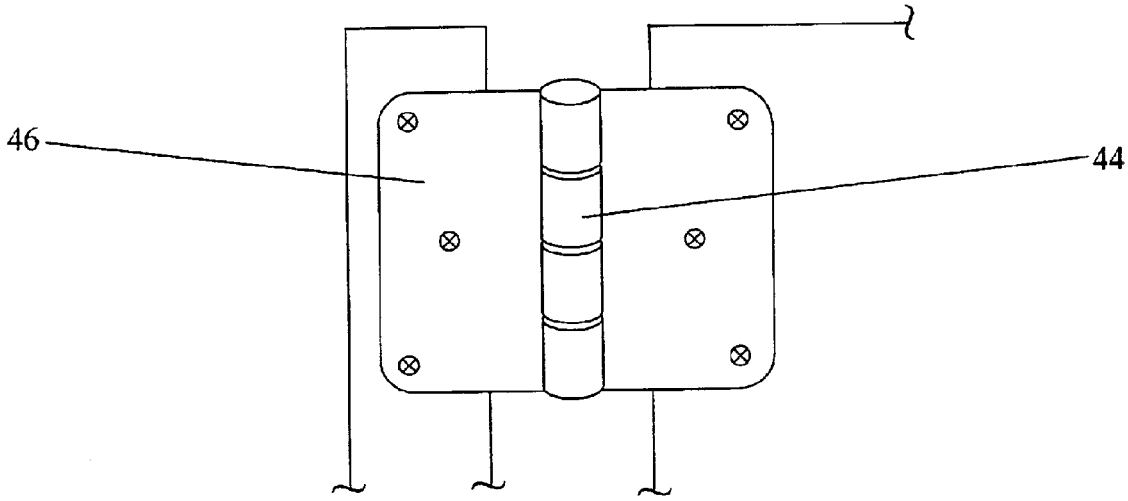
FIG. 9 is a perspective view of the hinge plates and one side of the hinge cylinder of a door hinge.
Figure 10:
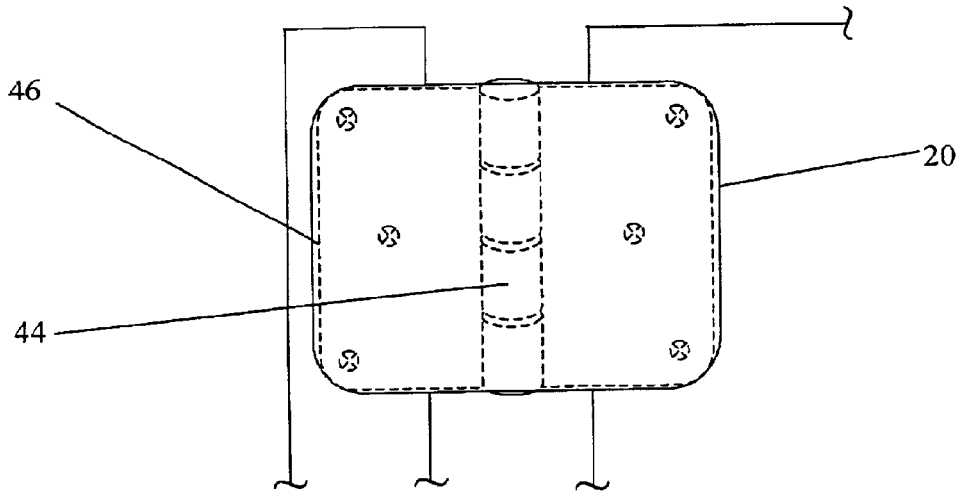
FIG. 10 is a perspective view of the hinge plates and one side of the hinge cylinder of a door hinge with the hinge protector of the present invention installed and covered items designated by dashes.

Use of the present invention is shown in FIGS. 9–13. FIG. 9 shows the hinge plate 46 and one side of the hinge cylinder 44. To install the hinge plate protector 20, simply align the magnetic portions 22 of the hinge plate protector 20 with the hinge plates 46 as shown in FIG. 10. In the most preferred embodiment, the edge of the hinge plate protector 20 aligns exactly with the edge of the hinge plate 46 such that the hinge plate 46 is covered completely but the hinge plate protector 20 does not extend over any of the area to be painted. The central, nonmagnetic portion 24 of the hinge plate protector 20 aligns generally with the hinge cylinder 44. For ease of illustration, FIG. 10 shows the edge of the hinge plate protector 20 extending beyond the edge of the hinge plate 46, although this would not be preferred in actual use.

Figure 11:
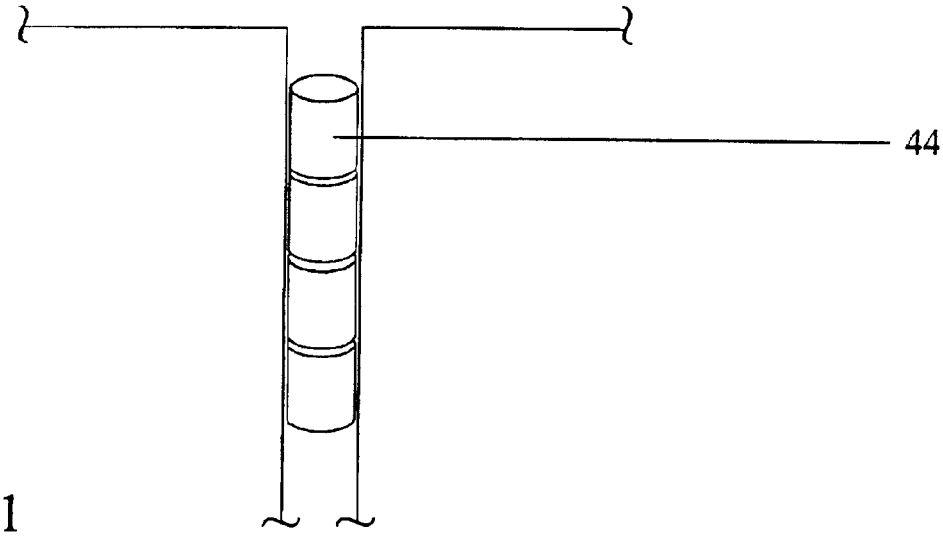
FIG. 11 is a perspective view of one side of the hinge cylinder of a door hinge.
Figure 12:
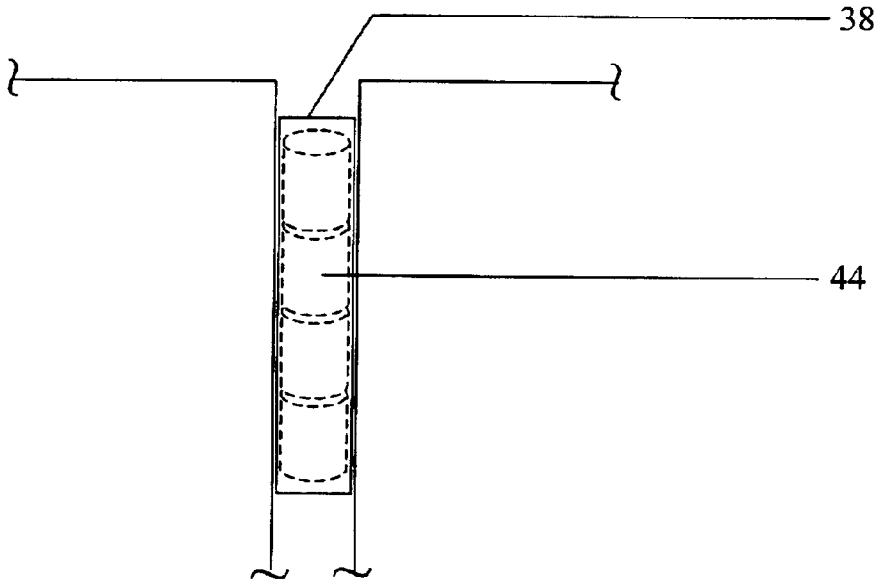
FIG. 12 is a perspective view of the hinge cylinder of a door hinge with the hinge cylinder protector of the present invention installed and covered items designated by dashes.
Figure 13:
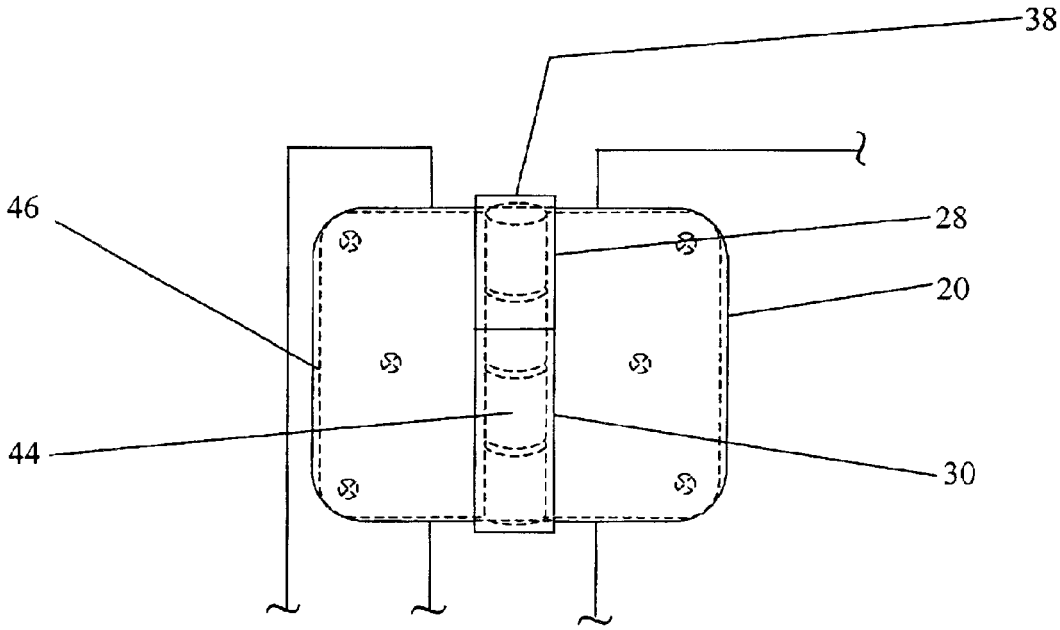
FIG. 13 is a perspective view of the door hinge with the present invention completely installed and covered items designated by dashes.

Once the hinge plate protector is installed, the hinge cylinder protector 38 can be installed as shown in FIGS. 11 and 12. FIG. 11 shows the hinge cylinder 44. The central portion 36 of the hinge cylinder protector 38 is installed over the hinge cylinder 44. The upper surface 32 of the central portion 36 of the hinge cylinder protector 38 fits over and protects the top of the hinge cylinder 44 while the lower surface 34 of the hinge cylinder protector 38 fits under and protects the bottom of the hinge cylinder 44. The strap 28 extending from the upper surface 32 of the hinge cylinder protector 38 is pulled over the hinge cylinder 44 and passed over top of the hinge plate protector 20. The strap 30 extending from the lower surface 34 of the hinge cylinder protector 38 is pulled under the hinge cylinder 44 and passed over top of the hinge plate protector 20. The straps 28, 30 are then connected to each other (or to the hinge plate protector 20 depending on the connection means selected) and the installation is complete as shown in FIG. 13.

As may be recognized, installation may be quickly achieved in a simple two-step process from a single location thus greatly increasing the speed and efficiency in which protection of the door hinges may be completed. To accomplish this from one location, simply attach the hinge plate protector 20 to the hinge plates 46 by aligning the magnetic material 22 with the hinge plates 46. Then, grasp the upper strap 28 of the hinge cylinder protector 38 and raise the hinge cylinder protector 38 over the door hinge and through the opening above the door hinge. Allow the lower strap 30 to drop behind the door hinge until it is hanging below the door hinge. Grasp the lower strap 30 and pull it through the opening below the door hinge and connect the lower strap 30 to the upper strap 28 (or connect each strap 28,30 to the hinge plate protector 20 if that connection means is chosen). The present invention removes any requirement to move to the opposite side of the door to complete the protection of the door hinge.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A door hinge cover for protecting door hinge plates and the hinge cylinder, comprising:

a hinge plate protector made from flexible material having first and second surfaces and having two outer external portions and a central portion wherein the two outer external portions on the first surface of the hinge plate protector include magnetic means for attaching to the door hinge plates; and a hinge cylinder protector made of flexible material for attaching to the hinge cylinder, comprising a central portion having upper and lower surfaces, two side surfaces and a rear surface wherein the central portion is shaped to cover one side of the hinge cylinder and wherein the two side surfaces of the central portion include magnetic means for attaching to the hinge cylinder; and two elongate strap portions for connecting the hinge cylinder protector to the hinge cylinder which strap portions extend from the upper and lower surfaces of the central portion of the hinge cylinder protector and wherein each of the elongate straps includes a connecting means for connecting the straps together.

2. The door hinge cover as set forth in claim 1 wherein the elongate straps include hook and loop fastener for connecting the straps together.

3. The door hinge cover set forth in claim 1 wherein the elongate straps include snaps for connecting the straps together.

4. The door hinge cover as set forth in claim 1 wherein the elongate straps include a button and a buttonhole for connecting the straps together.

5. A door hinge cover for protecting door hinge plates and the hinge cylinder, comprising:

a hinge plate protector made from flexible material having first and second surfaces and having two outer external portions and a central portion wherein the two outer external portions on the first surface of the hinge plate protector include magnetic means for attaching to the door hinge plates; and a hinge cylinder protector made of flexible material for attaching to the hinge cylinder, comprising a central portion having upper and lower surfaces, two side surfaces and a rear surface wherein the central portion is shaped to cover one side of the hinge cylinder and wherein the two side surfaces of the central portion include magnetic means for attaching to the hinge cylinder; and two elongate strap portions for connecting the hinge cylinder protector to the hinge cylinder which strap portions extend from the upper and lower surfaces of the central portion of the hinge cylinder protector, wherein the elongate strap portions and the second surface of the hinge plate protector include a connecting means for connecting the strap portions to the second surface of the hinge plate protector.

6. The door hinge cover as set forth in claim 5 wherein the elongate straps and the second surface of the hinge plate protector include hook and loop fastener for connecting the straps to the second surface of the hinge plate protector.

7. The door hinge cover as set forth in claim 5 wherein the elongate straps and the second surface of the hinge plate protector include snaps for connecting the straps to the second surface of the hinge plate protector.

8. The door hinge cover as set forth in claim 5 wherein the elongate straps and the second surface of the hinge plate protector include a button and a buttonhole for connecting the straps to the second surface of the hinge plate protector.

9. A door hinge cover for protecting door hinge plates and the hinge cylinder, comprising:

a hinge plate protector made from flexible, nonporous material having first and second surfaces and having two outer external portions and a central portion wherein flexible magnetic material is adhered to the two outer external portions on the first surface of the hinge plate protector for attaching the hinge plate protector to the door hinge plates; and a hinge cylinder protector made of flexible, nonporous material for attaching to the hinge cylinder, comprising a central portion having upper and lower surfaces, two side surfaces and a rear surface wherein the central portion is shaped to cover one side of the hinge cylinder and wherein flexible magnetic material is adhered to the two side surfaces of the central portion for attaching to the hinge cylinder; and two elongate strap portions for connecting the hinge cylinder protector to the hinge cylinder which strap portions extend from the upper and lower surfaces of the central portion of the hinge cylinder protector and which two strap portions include hook and loop fastener for connecting the straps together.

* * * * *